US010632514B2

(12) United States Patent
Strank et al.

(10) Patent No.: US 10,632,514 B2
(45) Date of Patent: Apr. 28, 2020

(54) METHOD AND APPARATUS FOR MAKING SEAMLESS PIPE

(71) Applicant: SMS GROUP GmbH, Duesseldorf (DE)

(72) Inventors: Hubert Strank, Uebach-Palenberg (DE); Peter Thieven, Aachen (DE); Helge Daehndel, Moenchengladbach (DE)

(73) Assignee: SMS GROUP GMBH, Duesseldorf (DE)

( * ) Notice: Subject to any disclaimer, the term of this patent is extended or adjusted under 35 U.S.C. 154(b) by 193 days.

(21) Appl. No.: 15/576,628

(22) PCT Filed: Jul. 4, 2016

(86) PCT No.: PCT/EP2016/065631

§ 371 (c)(1),
(2) Date: Dec. 6, 2017

(87) PCT Pub. No.: WO2017/005666

PCT Pub. Date: Jan. 12, 2017

(65) Prior Publication Data

US 2018/0169725 A1 Jun. 21, 2018

(30) Foreign Application Priority Data

Jul. 9, 2015 (DE) ..... 10 2015 212 905

(51) Int. Cl.
*B21C 45/00* (2006.01)
*B21B 17/04* (2006.01)
(Continued)

(52) U.S. Cl.
CPC ..... *B21C 45/00* (2013.01); *B21B 17/04* (2013.01); *B21B 25/04* (2013.01); *B21C 1/26* (2013.01);
(Continued)

(58) Field of Classification Search
CPC ..... B21B 17/02; B21B 17/04; B21B 25/04; B21C 45/00; B21C 3/08; B21C 5/003
See application file for complete search history.

(56) References Cited

U.S. PATENT DOCUMENTS 2,819,790 A 1/1958 Calmes
3,577,754 A * 5/1971 Calmes ..... B21B 17/04 72/45
(Continued)

FOREIGN PATENT DOCUMENTS

GB 1092717 A 11/1967
JP 57064404 A * 4/1982 ..... B21B 17/04
(Continued)

OTHER PUBLICATIONS

EPO machine translation of JP-57064404-A (Year: 2019).*

*Primary Examiner* — Pradeep C Battula
(74) *Attorney, Agent, or Firm* — Andrew Wilford

(57) ABSTRACT

The invention relates to a device and a method for producing a pipe (1) from a hollow block (2) which has an opening (3). The device has a rolling mill (30) for rolling the hollow block (2) via a rolling rod (21) introduced into the opening (3) of the hollow block (2), whereby the pipe (1) is produced. A retaining device (70) for retaining the pipe (1) is provided behind the rolling mill (30), and the device is further designed such that the rolling rod (21) can be drawn out of the pipe (1) after the rolling process while the pipe (1) is retained by the retaining device (70).

11 Claims, 3 Drawing Sheets

(51) Int. Cl.

| | |
|---|---|
| ***B21B 25/04*** | (2006.01) |
| ***B21C 3/08*** | (2006.01) |
| ***B21C 1/26*** | (2006.01) |
| ***B21C 5/00*** | (2006.01) |
| *B21B 23/00* | (2006.01) |

(52) U.S. Cl.
CPC ..... *B21C 3/08* (2013.01); *B21C 5/003* (2013.01); *B21B 23/00* (2013.01)

(56) References Cited

U.S. PATENT DOCUMENTS

| | | | | |
|---|---|---|---|---|
| 3,593,553 | A | 7/1971 | Rodder | |
| 4,095,447 | A * | 6/1978 | Shevchenko | B21B 17/04 72/208 |
| 9,597,718 | B2 * | 3/2017 | Yamane | B21B 17/02 |
| 2010/0269868 | A1 | 10/2010 | Nakaike | |

FOREIGN PATENT DOCUMENTS

| | | | |
|---|---|---|---|
| RU | 1765955 | C | 4/1996 |
| RU | 2333053 | C1 | 9/2008 |
| SU | 130473 | A | 11/1959 |
| WO | WO-2014017370 | A1 * | 1/2014 |

* cited by examiner

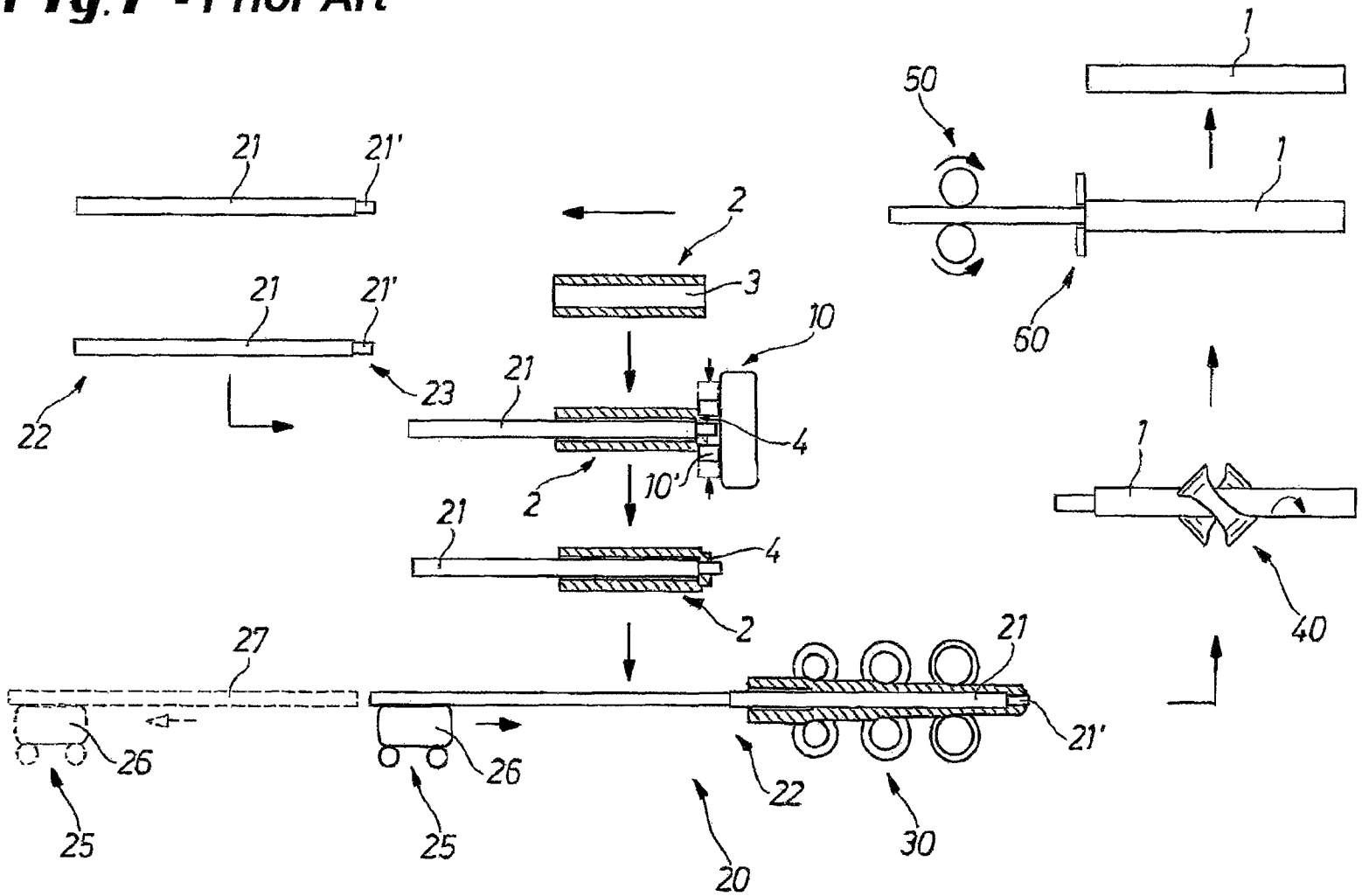
Fig.1 - Prior Art

METHOD AND APPARATUS FOR MAKING SEAMLESS PIPE

CROSS REFERENCE TO RELATED APPLICATIONS

This application is the US-national stage of PCT application PCT/EP2016/065631 filed 4 Jul. 2016 and claiming the priority of German patent application 102015212905.5 itself filed 9 Jul. 2015.

FIELD OF THE INVENTION

The invention relates to an apparatus and method for making a pipe from a tubular block having a passage, the apparatus having a roller mill for rolling the tubular block over a mandrel rod introduced into the passage of the tubular block.

BACKGROUND OF THE INVENTION

FIG. 1 shows a prior-art push bench 20 for manufacturing seamless pipes 1 from a tubular block 2. The figure also shows the manufacturing steps and the sequence thereof designated by arrows:

The tubular block 2 serves as the starting material. It is obtained, for example, by heating a solid block and piercing it by skew-rolling the block over a mandrel or pressing a piercing mandrel into it so that a passage 3 extends through the tubular block.

The tubular block 2 is then placed into a dishing press 10. It serves to compress together one end of the tubular block 2 such that a force-fit end 4 is formed for force-fitting to a mandrel rod 21 that is usually inserted into the undished tubular block or, alternatively, in the following step, into the passage 3 of the tubular block 2. The assembly of the tubular block 2 and the mandrel rod 21 is then introduced into the intake end of the push bench 20.

A drive apparatus 25 with a feeder 26 and a pusher rod 27 presses the mandrel rod 21 and the tubular block 2 forward through the push bench 20. For this purpose, the feeder 26 pushes the shaft rod 27 forward, and this, in turn, acts on a rear end 22 of the mandrel rod 21. The mandrel rod 21 and the tubular block 2 are driven forward together through a roller mill 30 by the force-fitted end 4 of the tubular block 2 produced previously in the dishing press 10, with the tubular block 2 acting on the front end 23 of the mandrel rod 21. The rollers in the push bench 20 are not driven. The tubular block 2 is thus rolled onto the mandrel rod 21 during the pushing process. A shaping, particularly an elongation, of the tubular block 2 takes place as can be seen from FIG. 1. The semifinished product manufactured in this way—the pipe 1—is also referred to in the technical field as a tubular.

After rolling-out the tubular block 2 to form the pipe 1, the drive apparatus 25 returns with the shaft rod 27 into the starting position. This causes the mandrel rod 21 and the shaft rod 27 located in the rolled pipe 1 to separate from one another. The push bench 20 is ready for the next rolling cycle.

Parallel to this, the rolled-out pipe 1 is pushed with the mandrel rod 21 into a detaching roller mill 40, also called a reeler, that serves to separate the pipe 1 and the mandrel rod 21 from each other. To this end, the diameter of the pipe 1 is enlarged by a rolling process between skew pairs of concave rollers, so that the pipe 1, which has shrunk onto the mandrel rod 21 as a result of the temperature loss, can be separated from the mandrel rod.

In an extractor 50, the mandrel rod 21 is then pulled rearward out of the pipe 1. At the same time, the pipe 1 is held back by a clamp 60. After that, the pipe 1 can be conveyed to other processing steps, such as for diameter and/or size reduction. The mandrel rod 21 is returned to the mandrel rod cycle.

Conventional system and method layouts are described in:

"Herstellung von Rohren" ["Manufacture of Pipes"], Verlag Stahleisen MbH, Düsseldorf, 1975, image 3, p. 16 and image 14, p. 26

Burkhard Schifferings, "Herstellverfahren für nahtlose Rohre mit kleiner and mittlerer Kapazität" ["Manufacturing methods for small- and medium-capacity seamless pipes"], Neue Hütte, volume 32, issue 1, 1987

Additional methods and apparatuses also are seen in DE 1 452 255 and U.S. Pat. No. 2,819,790.

During separation of the pipe 1 from the mandrel rod 21, the pipe 1 is widened in the above-mentioned skew rolling process in the detaching mill 40 so that the mandrel rod 21 can be pulled out. This process results in deformation of the pipe 1, which can degrade the product quality. In particular, the danger exists of the wall thickness of the pipe 1 becoming irregular.

Moreover, the detaching mill 40 and the extractor 50 are system components that are made available as part of the push bench 20 or as separate system parts and must be configured and maintained in order to work together with the push bench 20. Furthermore, the system cannot do without technical means for transporting and circulating of the mandrel rods 21 between the individual stations.

OBJECT OF THE INVENTION

One object of the invention consists in providing an apparatus and a method of manufacturing pipes of improved quality and/or simplified apparatus construction.

SUMMARY OF THE INVENTION

The object is achieved with an apparatus in the apparatus according to the invention that is designed for manufacturing a seamless pipe from a tubular block. The tubular block has a passage that may be a through hole or an elongate blind hole that is closed at one end. The apparatus has a roller mill. In order to roll out the tubular block, a mandrel rod, which can also be part of the apparatus, is introduced into the passage thereof and an assembly formed by the mandrel rod and the tubular block is fed to the roller mill where the tubular block is rolled out over the mandrel rod, thus making a pipe. It can be seen from the shape of the passage of the tubular block (which passage can be a blind hole or a through hole) that, in the present text, "pipe" refers to a cylindrical tubular body both with a passage the passes completely through and with a passage that is closed at one side. Furthermore, the tubular block and/or the pipe can be cylindrical in a general sense, but there is no limitation to a circular cylinder. Preferably, the apparatus is a push bench in which the rollers in the roller mill are not driven.

According to the invention, a clamp is provided downstream of the roller mill in order to hold the pipe. For this purpose, a force is preferably applied to the pipe that is exerted by the mandrel rod and acts counter to the forward direction of rolling. Furthermore, the mandrel rod can be pulled out of the pipe after rolling, that is, it can be preferably moved counter to the feed direction. In combination with the clamp, the pipe is thus pulled from the mandrel rod after rolling. In other words, a relative movement is produced between the pipe and the mandrel rod by the clamp and the withdrawal of the mandrel rod such that the two are separated from one another. This means that the pipe need not necessarily (but by all means can) hold the pipe stationary, but rather need only guide it such that the mandrel rod can be pulled out of the pipe with a rearward motion. The mandrel rod then returns directly to the starting point, that is, the place in which the mandrel rod is introduced into a tubular block.

In the present text, when the terms "upstream of" and "downstream of," "front" and "back," etc., are used, they are referring to locations relative to the direction of rolling. Therefore, "downstream of" the roller mill means downstream in the direction of rolling, or, to use the terms of the process, after rolling. Similarly, the "front end" or "rear end" (of the mandrel rod, for example) are determined unequivocally relative to the direction of transport through the roller mill.

Instead of using a detaching mill for separating the pipe from the mandrel rod, the pipe is pulled off of the mandrel rod downstream of the roller mill by the clamp, preferably directly along the travel path through the roller mill, and preferably immediately downstream of the roller mill. The pipe thus has no time to cool off to the point that it shrinks firmly onto the mandrel rod. Means, such as for example insulation, can be provided in order to prevent or retard the cooling of the pipe until extraction.

The apparatus according to the invention thus forgoes a detaching mill. In particular, skew rolling in the reeler for the purpose of separating the pipe from the mandrel rod is eliminated, thereby preventing the disadvantageous and unwanted deformation of the pipe generally associated therewith. The quality of the product is improved, and in particular an especially uniform wall thickness of the extracted pipe can be ensured. Moreover, the temperature loss of the pipe before the subsequent processing, in the form for example of a size or stretch reduction, is reduced, so that post-production heating can also be eliminated if desired. By eliminating the detaching mill, the apparatus can thus be operated in a more energy-efficient manner in several respects and in certain embodiments there is no detaching mill, no post-production heating, and no circulation of a plurality of mandrel rods.

Beside the above contributions to the improvement of the quality of the product and to energy savings, the construction of the apparatus is simplified by eliminating a detaching mill and a circulating system for mandrel rods. This, in turn, enables savings to be achieved in tool provisions and investment costs. Instead of a plurality of mandrel rods in the circulating system, it is possible to use only one mandrel rod. The laborious changing of mandrel rods can thus be omitted. The mandrel rod can be used for several successive "pokes." The technology described herein is therefore particularly suitable for small systems.

Preferably, the apparatus has a shaft rod that can be connected for transmitting tension and compression to the mandrel rod. Inasmuch as the mandrel rod is pulled "rearward" out of the pipe, it is preferably capable of transmitting tensile force and preferably securely connected to the shaft rod. The shaft rod and the mandrel rod can be screwed together, for example. Preferably, the two rods are screwed into one another with their ends appropriately provided with respective internal or external threads. The mandrel rod and the shaft rod thus preferably remain securely interconnected for several rolling cycles. In this case, a laborious exchanging of mandrel rods is eliminated.

Preferably, while the pipe is being held, the mandrel rod can be retracted in the reverse direction along the travel path through the roller mill. In this embodiment, a reciprocating movement of the mandrel rod (optionally with the shaft rod attached thereto) thus occurs along the rolling travel path that is readily achievable from a technical perspective.

Preferably, the clamp has a retaining block that can be brought in contact with a rear end face of the pipe while the mandrel rod is being pulled out of the pipe. The pipe is thus pulled off of the mandrel rod in a technically simple manner. Alternatively, the pipe can be held relative to the mandrel rod by drive rollers, a drawing point, or in another manner.

Preferably, a dishing press is provided upstream of the roller mill that is provided for the purpose of deforming, that is for example pressing together partially or completely, a portion of the tubular block so that it can be brought into frictional and/or form-fitting contact with the mandrel rod. Preferably, a front portion and/or the front end of the tubular block is deformed. The dishing press is preferably incorporated into the rolling travel path of the apparatus and aligned appropriately relative to the position of a first roller assembly of the roller mill. According to a preferred embodiment, the dishing is thus performed in the flow of rolling. The dishing press provided at the inlet of the roller mill works together especially well with an apparatus described herein so as to eliminate circulation of the mandrel rod and/or the separation of the mandrel rod from the shaft rod.

Preferably, the mandrel rod and/or, optionally, the shaft rod has one or more cooling conduits through which a fluid coolant, preferably water, can flow. Such a measure is advantageous given the high load to which the mandrel rod is subjected, particularly while being pulled out of the pipe. The cooling of the mandrel rod can also be achieved by other technical means. Nevertheless, the cooling by an integrated cooling conduit represents the preferred variant, since an undesired or excessive cooling of the pipe is effectively avoided in this way. Preferably, an elongated cooling conduit is provided along the center axis of the mandrel rod. According to another embodiment, a cooling pipe is provided in the cooling conduit, preferably coaxially to the cooling conduit, that extends into the vicinity of the front end of the mandrel rod, conducts the coolant there, and delivers it through a passage of the cooling pipe into the cooling conduit.

In summary, the method according to the invention for manufacturing a pipe from a tubular block having a passage comprises the steps of introducing the mandrel rod into the passage of the tubular block;

transporting of the unit of mandrel rod and tubular block through the roller mill for the rolling of the tubular block over the mandrel rod such that the pipe is produced;

holding of the pipe by the clamp, and extraction of the mandrel rod from the passage of the pipe while the pipe is being held.

Preferably, the mandrel rod is used for several rolling cycles, with a respective tubular block being rolled into a pipe in each cycle, particularly without separation between the mandrel rod and the shaft rod when a shaft rod is provided.

The described apparatuses and methods are especially well suited to pipes having a large diameter, for example up to about 37 cm (14"), and/or small systems up to 200,000 Jato, for example.

Additional advantages and features of the present invention can be seen from the following description of preferred embodiments. The features described below can be implemented alone or in combination with one or more of the above-mentioned features, provided that the features do not contradict one another. The following description of the preferred embodiments makes reference to the accompanying drawings.

BRIEF DESCRIPTION OF THE DRAWING

FIG. 1 schematically shows the construction of a push bench for manufacturing seamless pipes, with a detaching mill and extractor, as well as a corresponding manufacturing method.

DETAILED DESCRIPTION OF THE INVENTION

Preferred embodiments will be described below with reference to the figures. Same or similar elements, or elements having equivalent function are provided with identical reference symbols in the figures, and a repeated description of these elements is omitted in part to avoid redundancy. The description of the embodiments is given starting from and in consideration of the schematic representation of FIG. 1, which was already described in the introductory section; in particular, with the notation and reference symbols maintained in order to simplify the description.

Figure 2A:
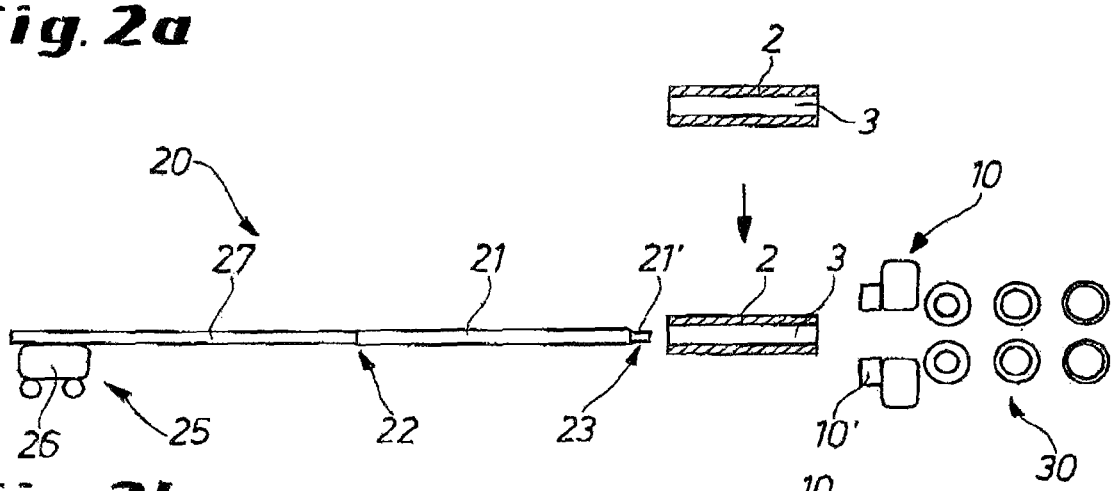
FIGS. 2*a* to 2*d* schematically show the construction of a push bench that does not have a detaching mill and a conventional extractor. Furthermore, a method of manufacturing seamless pipes by such a push bench follows is seen in the figures.

FIG. 2*a* shows a tubular block 2 that is first processed by a dishing press 10. Unlike the system of FIG. 1, the dishing press 10 is located in the travel path of the push bench 20 upstream of the roller mill 30. In this sense, the dishing press 10 is integrated into the push bench 20 in this embodiment, and the tubular block 2 is placed without previous processing by a separate dishing press into the upstream intake end of the push bench 20.

Alternatively, the processing can be performed by the dishing press 10 as shown in FIG. 1 or also in another way, or it can be omitted. In particular, according to one embodiment, the pressing-together or deforming of the tubular block 2 in a dishing press 10 can be omitted, for example if the tubular block 2 is provided with a blind hole instead of a through hole, or the force-fitting end is produced directly during casting or molding of the tubular block 2. What is important is that the tubular block 2 be shaped such that it can be pushed by the mandrel rod 2 through the push bench. For that purpose, a frictional and/or form-fitting connection can be established between the tubular block 2 and the mandrel rod 21.

Figure 2B:
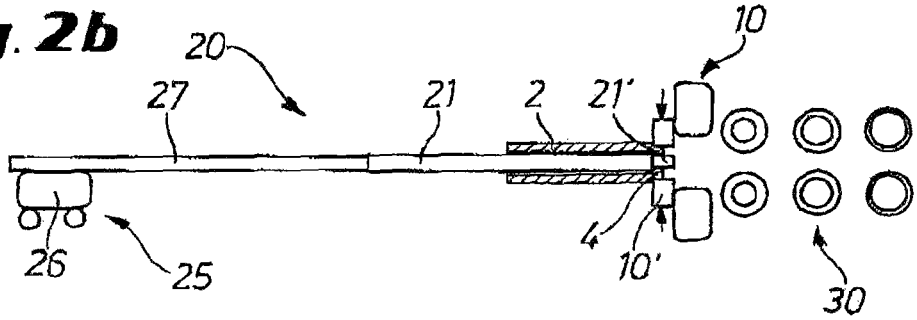

In the case of the specific embodiment of FIG. 2*a*, an end of the tubular block 2 is pressed together by the dishing press 10 immediately upstream of the roller mill 30 such that a friction-fit end 4 is formed with the tubular block 2—frictional with respect to the mandrel rod 21 that is preferably moved into the passage 3 of the undished tubular block 2. In this example, the mandrel rod 21 has an offset or projection 21' having a reduced diameter that is provided for guiding through the open front end 4 of the tubular block 2. This can be seen especially clearly in FIG. 2*b*.

In the method step of FIG. 2*a*, the drive apparatus 25 with the feeder 26 and the shaft rod 27 and the rolling rod 21 are retracted and are waiting for the tubular block 2.

As soon as the tubular block 2 has been introduced into the intake end of the push bench 20, the drive apparatus 25 to which the shaft rod 27 and the mandrel rod 21 are connected advances and pushes the mandrel rod 21 into the tubular block 21.

The tubular block 2 is subsequently moved by the drive apparatus 25 with the mandrel rod 21 into the workspace of the dishing press 10. This work step follows from FIG. 2*b*. Optionally, auxiliary drives for guiding or transport can be provided. The dishing press 10 has clamping jaws and/or work rolls 10' that, by converging or pressing, form the preferably narrowed end 4 deformed for the force-fit.

The shaft rod 27, driven by the feeder 26, then pushes the tubular block 2 with the mandrel rod 21 inside through the roller mill 30 of the push bench 20. The tubular block 2 and the mandrel rod 21 are pushed through an axial passage of the dishing press 10. During the pushing process, the tubular block 2 is rolled by the roller mill 30 onto the mandrel rod 21, so that the pipe 1, also referred to as a tubular, is produced. A shaping of the tubular block 2, and particularly elongation thereof, takes place here. This process can be seen in comparing FIGS. 2*b* and 2*c*.

Figure 2C:
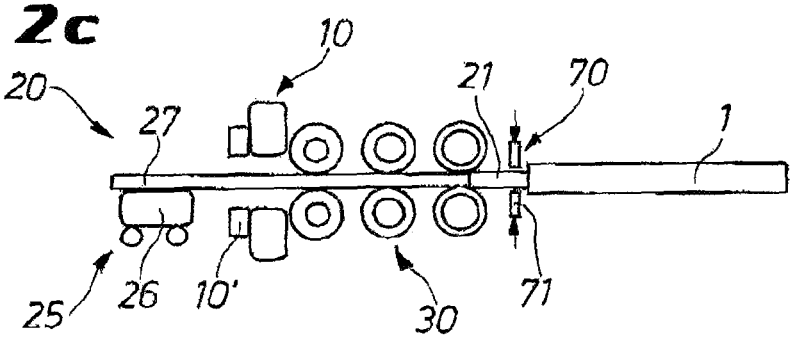

After piercing, the drive apparatus 25 stops and holds the mandrel rod 21 and the tubular 1 rolled thereon in a predetermined position. There, a clamp 70 then engages on the tubular 1 as shown in FIG. 2*c*. For the sake of example, the clamp 70 is equipped with a closeable draw-off clamp 71 having a solid, perforated, optionally movable plate. Alternatively, the tubular 1 can be held in place by gripper arms, drive rollers, a drawing point, or in another manner.

Figure 2D:
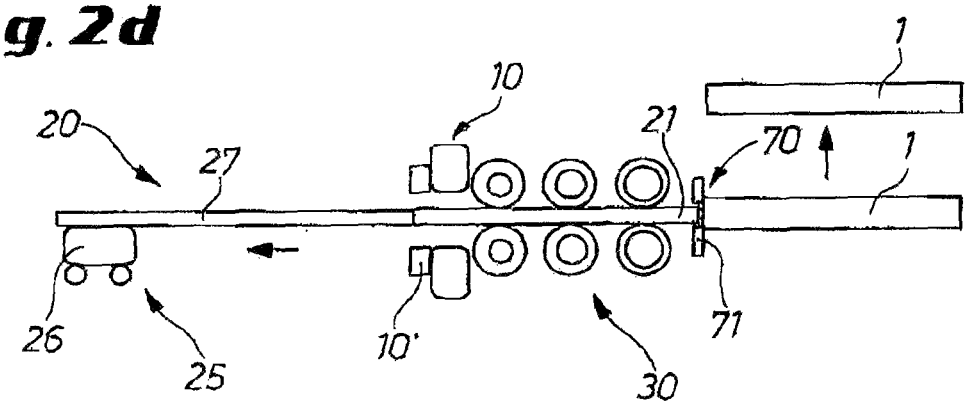

As the drive apparatus 25 returns to the starting position and entrains not only the shaft rod 27 but also the mandrel rod 21—see FIG. 2*d*—the mandrel rod 21 is pulled straight back out of the tubular 1 that is simultaneously held back by the draw-off clamp 71. The mandrel rod 21 can be returned without circuitous travel—that is, without being removed from the rolling travel path—and be prepared, positioned, and/or aligned for the next tubular block 2.

Instead of a detaching mill 40, the tubular 1 is separated from the mandrel rod 21 in the travel path of the push bench 20 by the draw-off clamp 71 and the rearward movement of the mandrel rod 21. This preferably occurs immediately downstream of the roller mill 30 so that the tubular 1 does not cool or only cools minimally and does not have the opportunity to shrink firmly onto the mandrel rod 21. Means—such as insulation, for instance—can be optionally provided in order to prevent or retard the cooling of the tubular 1 until extraction.

The above construction does without a detaching mill 40 and a separate extractor 50 provided outside the push bench 20. In particular, the skew rolling in the reeler for the purpose of separating the tubular 1 from the mandrel rod 21 is eliminated, thereby preventing deformation of the tubular 1 that is generally associated therewith. The quality of the product increases; in particular an especially uniform wall thickness of the extracted tubular 1 can be ensured. Moreover, the temperature loss of the tubular 1 before the subsequent processing—in the form of a size or stretch reduction, for example—is reduced, so that post-production heating can also be eliminated if desired. By eliminating the detaching mill 40, the apparatus can thus be operated in a more energy-efficient manner in several respects and in certain embodiments there is no operation of a detaching mill 40, no post-production heating, and no circulation of a plurality of mandrel rods.

Besides the contributions to the improvement in the quality of the pipe 1 or semifinished product that is manufactured, a detaching mill 40 is eliminated, as is a circulating system for the mandrel rod 21. This, in turn, results in savings in tools and investment costs. Instead of many mandrel rods in the circulating system, it is possible to use only one mandrel rod 21. The laborious changing of mandrel rods can be omitted. The mandrel rod 21 can be used for several successive "pokes." The technology described herein is therefore particularly suitable for small system types.

The described process requires a special tool design in which the mandrel rod 21 must be retractable; preferably the mandrel rod 21 must be able to be pulled back from the shaft rod 27. In this case, the shaft rod 27 and the mandrel rod 21 must be resilient to tensile loads.

Figure 3:
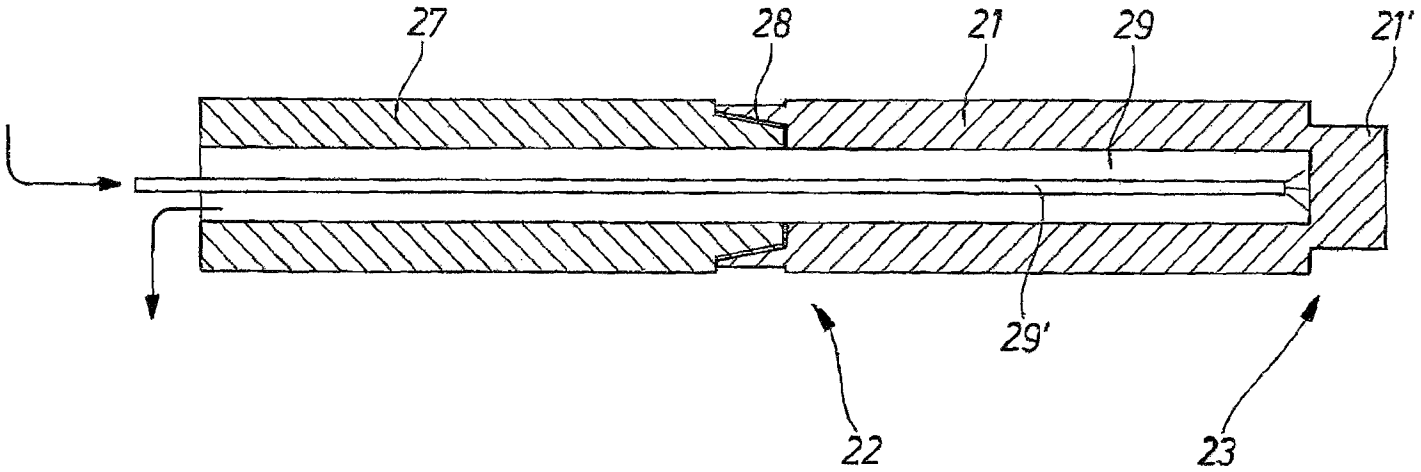
FIG. 3 shows a connection between a mandrel rod and a shaft rod with an integrated cooling conduit.

For this purpose, the mandrel rod 21 and/or the shaft rod 27 is preferably cooled. The cooling can be achieved by the internal cooling illustrated in FIG. 3. FIG. 3 shows the connection area between shaft rod 27 and mandrel rod 21. The connection can be a screw connection 28, for example. Other types of connection are possible as long as they can withstand a tensile load. Alternatively, the mandrel rod 21 and the shaft rod 27 can be integrally formed. An embodiment is also possible in which the connection between shaft rod 27 and mandrel rod 21 is not designed for tensile resilience and the mandrel rod 21, after passing through the push bench 20 from the side opposite the shaft rod 27, is pressed together or otherwise pulled out of the pipe 1 and retracted.

The above-mentioned internal cooling of the unit of shaft rod 27 and mandrel rod 21 is shown in FIG. 3. For this purpose, a longitudinal passage or a cooling conduit 29 is provided for transporting a coolant, preferably water. The cooling conduit 29 preferably extends centrally and in the axial direction of the mandrel rod 21 and/or shaft rod 27.

According to a preferred embodiment, an inner pipe 29' is located in the cooling conduit 29 that conducts the coolant into the rod tip. The preferably pressurized coolant can escape from the cooling conduit 29 through a rear end of the passage of the tubular shaft rod 27, for example, and be optionally returned to the cooling circuit.

The above-described apparatuses and methods are especially well suited to pipes having a large diameter, for example up to about 37 cm (14"), and/or small system capacities up to 200,000 Jato, for example.

Insofar as applicable, all of the individual features that are described in the embodiments can be combined with one another and/or exchanged without departing from the scope of the invention.

The invention claimed is:

1. An apparatus for making a pipe from a tubular block having a passage, the apparatus comprising:

a mandrel rod in the passage and connected to the tubular block;

a shaft rod releasably connected to the mandrel rod for transmitting tensile and compressive force thereto in a travel direction of the tubular block and extending out of the passage opposite to the travel direction;

a roller mill for rolling the tubular block in a forward in the travel direction over the mandrel rod introduced into the passage of the tubular block such that the pipe is produced;

a dishing press upstream of the roller mill along a rolling travel path for deforming and pressing together partially or completely a portion of the tubular block for frictional form-fitting contact with the mandrel rod;

a clamp downstream in the direction of the roller mill for arresting the pipe; and means for pulling the mandrel rod out of the pipe by exerting traction on the shaft rod while the pipe is arrested by the clamp.

2. The apparatus defined in claim 1, wherein the shaft rod and the mandrel rod are screwed together.

3. The apparatus defined in claim 1, further comprising:

means for, while the pipe is arrested by the clamp, retracting the mandrel rod by the means upstream in the travel direction along the travel path during rolling.

4. The apparatus defined in claim 1, wherein the clamp has a retaining block that, while the mandrel rod is being pulled out of the pipe, is engageable with a rear end face of the pipe.

5. The apparatus defined in claim 1, wherein the mandrel rod has a cooling conduit through which a fluid coolant can flow.

6. The apparatus defined in claim 5, further comprising:

a cooling pipe in the cooling conduit that extends into the vicinity of a front end of the mandrel rod and can conduct the coolant there and deliver it through a passage of the cooling pipe into the cooling conduit.

7. A method of making a pipe from a tubular block having a passage, the method comprising the steps of:

introducing a mandrel rod in a forward travel direction defining a rolling travel path into the passage of the tubular block;

deforming and pressing together a portion of the tubular block partially or completely before rolling by a dishing press provided in the rolling travel path so that the tubular block and mandrel rod come into frictional form-fitting contact at the deformed portion;

releasably connecting a shaft rod to the mandrel rod with the shaft rod extending upstream in the travel direction of the block out of the block;

transporting an assembly of the mandrel rod and the tubular block along the travel path through a roller mill in order to roll the tubular block over the mandrel rod such the pipe is produced; and arresting the pipe with a clamp and pulling the mandrel rod out of the passage of the pipe by exerting upstream traction on the shaft rod.

8. The method defined in claim 7, wherein, further comprising the step, while the pipe is being held by the clamp, of retracting the mandrel rod upstream in the travel direction along the travel path during rolling.

9. The method defined in claim 7, wherein the clamp has a retaining block, the method further comprising the step, while the mandrel rod is being pulled out of the pipe, of:

bringing the retaining block into contact with an upstream end face of the pipe.

10. The method defined in claim 7, further comprising the step of:

cooling the mandrel rod during rolling and/or while being pulled out of the pipe by flowing a fluid coolant in a conduit formed in the mandrel rod.

11. The method defined in claim 7, wherein the mandrel rod is used for several directly successive rolling cycles, with a respective tubular block being rolled into a pipe in each cycle.

* * * * *